US005924524A

United States Patent [19]

Barker et al.

[11] Patent Number: 5,924,524

[45] Date of Patent: Jul. 20, 1999

[54] INTEGRATED, MULTI-LEVEL ELEVATOR SHUTTLE

[75] Inventors: Frederick H. Barker, Bristol; Gilbert W. Wierschke, West Simsbury; Paul Bennett, Waterbury; Anthony Cooney, Unionville; Richard C. McCarthy, Simsbury; Joseph Bittar, Avon; Bruce A. Powell, Canton; Samuel C. Wan, Simsbury, all of Conn.

[73] Assignee: Otis Elevator Company, Farmington, Conn.

[21] Appl. No.: 08/751,797

[22] Filed: Nov. 18, 1996

Related U.S. Application Data

[63] Continuation-in-part of application No. 08/684,867, Jul. 25, 1996, abandoned.

[51] Int. Cl.[6] ..... B66B 9/00

[52] U.S. Cl. ..... 187/249; 182/12

[58] Field of Search ..... 187/249, 257, 187/256, 414, 380; 182/12

[56] References Cited

U.S. PATENT DOCUMENTS 5,419,414 5/1995 Sakita ..... 187/249

FOREIGN PATENT DOCUMENTS 404159993A 6/1992 Japan ..... 187/249

OTHER PUBLICATIONS

Strackosch, G.R.; "Vertical Transportation: Elevators and Escalators"; pp. 472–475; New York: 1983.

*Primary Examiner*—Kenneth Noland

[57] ABSTRACT

An elevator system provides service between a ground level and each of three upper levels through a single elevator shuttle hoistway system. Three elevator cabs 34–36, B, D, F are moved in a triple deck elevator car frame 35, or a four deck elevator car frame 75 in a low hoistway 26, 76; two cabs are moved in a double deck elevator car frame 30 or four deck car frame 76 in a mid hoistway 27, 52; and one cab is moved in a single deck car frame 31 or triple deck car frame 77 in a high hoistway 28, 53. Other embodiments have other car frame arrangements.

6 Claims, 9 Drawing Sheets

HI 28
MID 27
LO 26
44
43
42
41
40
39
49
48
47
36
35
34
31
30
29

HI 53
MID 52
LO 51

105
104
108
103
111
107
106
110
109

INTEGRATED, MULTI-LEVEL ELEVATOR SHUTTLE

This is a continuation-in-part application of application Ser. No. 08/684,867, filed Jul. 25, 1996, now abandoned.

TECHNICAL FIELD

This invention relates to elevator shuttles in which cabs destined for any given level ride upwardly through hoistways carrying cabs for lower levels on the same, multi-deck elevator car frames.

BACKGROUND ART

Since all of the passengers for upper floors of a building must travel upwardly through the lower floors of the building, very tall buildings require effective use of elevator hoistways in order to conserve space used for elevators (referred to herein as the "core" of the building). In a commonly owned U.S. patent application Ser. No. 08/564,703, filed on Nov. 29, 1995, an elevator shuttle includes overlapping elevator hoistways, each having a double deck car frame therein. A cab traveling in one direction (up, down) is transferred from the lower deck of one elevator car frame to the lower deck of the other car frame, simultaneously with transferring a cab traveling in the opposite direction (down, up) from the upper deck of the other car frame to the upper deck of the one car frame.

A commonly owned U.S. patent application Ser. No. 08/588,577 filed on Jan. 18, 1996 discloses an elevator shuttle system employing extra deck car frames that can provide elevator service in a similar manner between a pair of landings, utilizing three or more hoistways.

In both of the aforementioned shuttles, service is provided only between a first level of a building and a second level which is vertically remote from the first level. A commonly owned U.S. patent application Ser. No. 08/564,534, filed on Nov. 29, 1995, discloses a synchronous elevator that provides service to three floors using two elevator hoistways, with each elevator cab traversing a fixed route from one landing at a first level to a second landing at a second level and so forth until it reaches a second landing at the first level, after which it proceeds to other landings at other levels until it returns to the first landing at the first level. However, that system provides a balanced transfer between each of the three levels and each other of the three levels. In that system, much of the capacity of the system is utilized for traffic between the intermediate level and both the lower level and the upper level, in addition to travel from the lowest level to the highest level.

DISCLOSURE OF INVENTION

Objects of the invention include reducing building core space requirements in providing elevator shuttle service to a plurality of upper levels in the building.

An elevator shuttle comprises a plurality of overlapping, contiguous elevator hoistways, each successively higher hoistway of the shuttle carrying one less cab than the next lower hoistway of the shuttle, on multi-deck car frames. In one embodiment of the invention, the elevator car frame in any hoistway waits, with the cab serving the level at the high end of that hoistway, while any other elevator cab serving levels higher than that travel upwardly through the building, exchange passengers, and return to that level. In other embodiments of the invention, extra deck, multi-deck elevator car frames are utilized with a pair of cabs to serve each level so that a car frame reaching a level simply exchanges cabs with a car frame traveling above it in the building, and/or with a passenger landing at that level.

The invention uses a single element of building core space between each general level of the building to provide, however, service from a first level to a plurality of levels, whereby increasing the amount of building space which may be occupied, thereby to derive income for the building.

Other objects, features and advantages of the present invention will become more apparent in the light of the following detailed description of exemplary embodiments thereof, as illustrated in the accompanying drawing.

BEST MODE FOR CARRYING OUT THE INVENTION

Figures 1, 2, 3, 4, 5, 6:
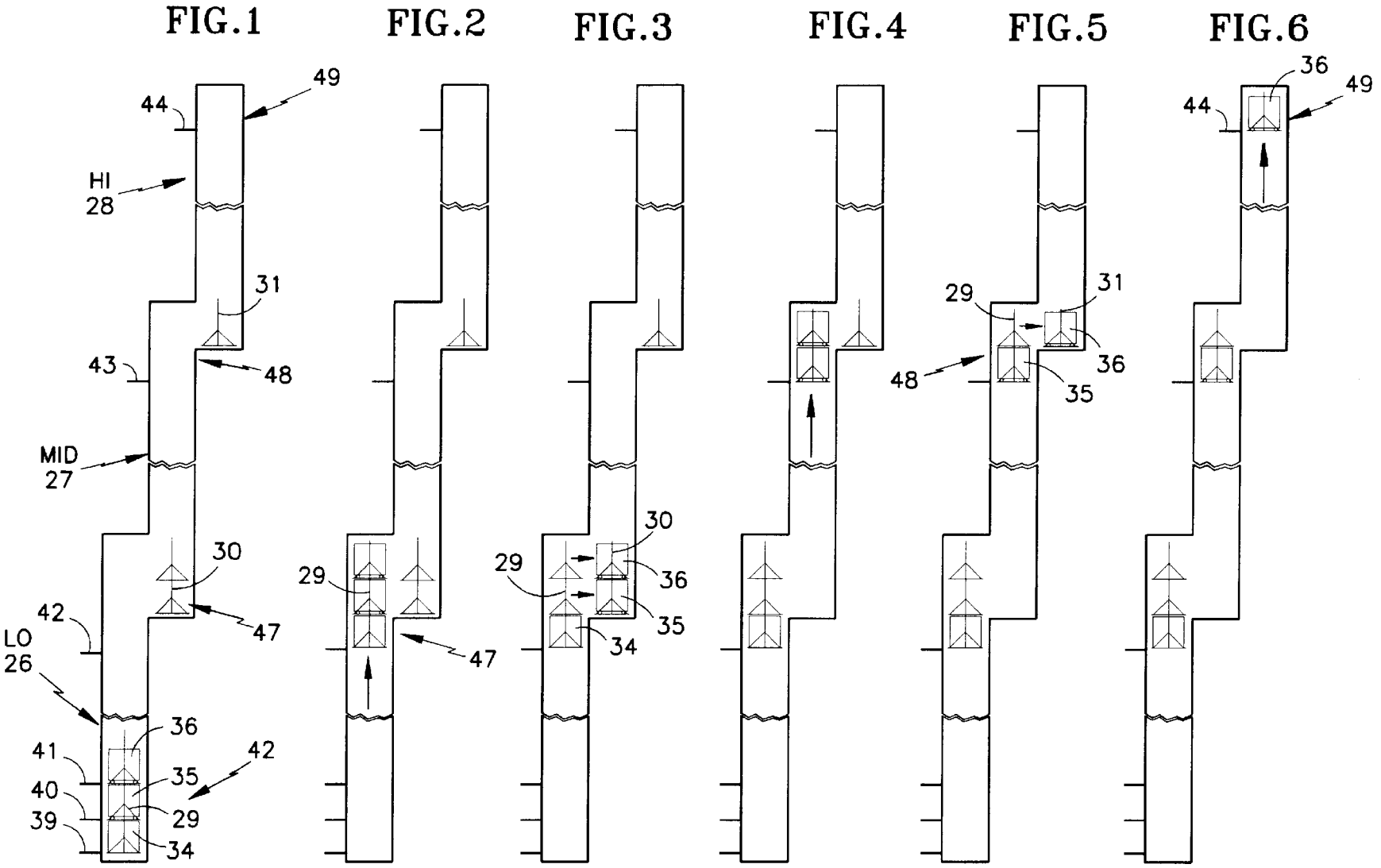
FIGS. 1–11 are simplified, stylized, schematic side elevation views of a shuttle in accordance with a first embodiment of the invention, showing the progress of the elevator cabs through the building.

Referring to FIG. 1, an elevator shuttle comprises a plurality of contiguous, overlapping hoistways including a low hoistway 26, a mid hoistway 27, and a high hoistway 28. The low hoistway has a triple deck elevator car frame 29 moveable therein, the mid hoistway has a double deck elevator car 30 moveable therein, and the high hoistway has a single deck elevator car moveable therein. The triple deck car frame 29 has a normal elevator cab 34 fixed thereon. The upper two decks of the car frame 29 have moveable cabs 35, 36 disposed thereon in FIG. 1. In FIG. 1, the other two car frames 30, 31 are empty. The cabs 34–36 receive passengers from related landings 39–41 at the ground level of the building, the destination of which are to corresponding landings 42–44 at first, second and third upper levels 47–49 of the building, respectively.

Figure 7:
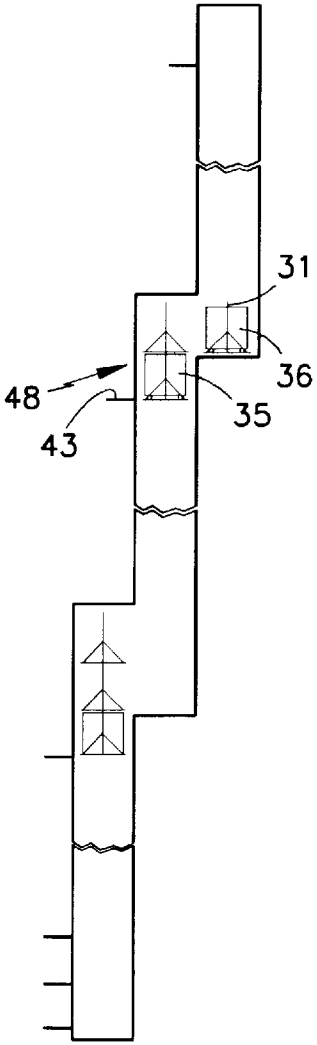

When passengers have been loaded on the cabs 34–36 at the ground level 42, the car frame 29 is raised to the second level 47 as shown in FIG. 2. Then (FIG. 3) the cab 34 will remain on the car frame 29 at the second level, but the cabs 35 and 36 are transferred to the double deck car frame 30 for further travel upwardly in the building, as shown in FIG. 4. In FIG. 5, the cab 35 remains in the car frame 29 at the second upper level 48 but the cab 36 is transferred into the single deck car frame 31. Then, the cab 36 finally reaches the landing 44 at the third upper level 49 of the building, where passengers exit, and other passengers enter the cab. In FIG. 7, the single car frame 31 travels back to the second upper level 48 with the cab 36 thereon. At this time, unloading and reloading of the cab 35 with respect to the landing 43 will be completed.

Figure 11:
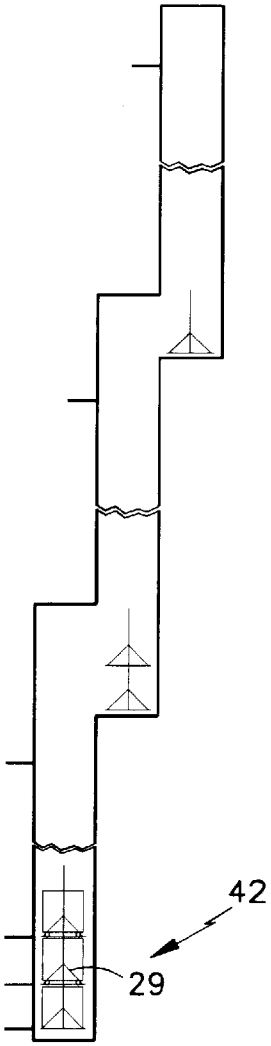
Figure 10:
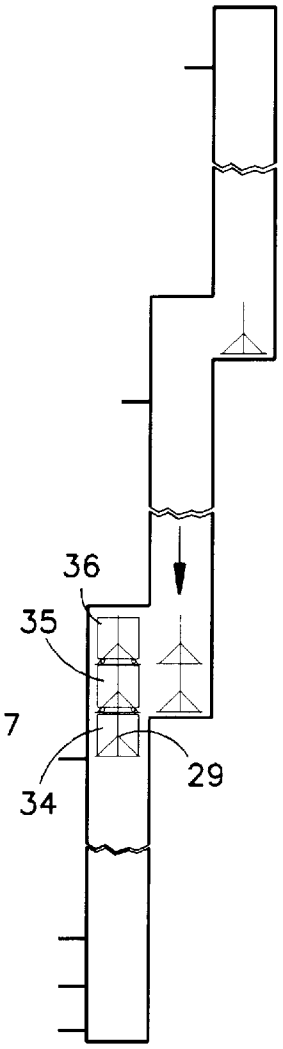
Figure 9:
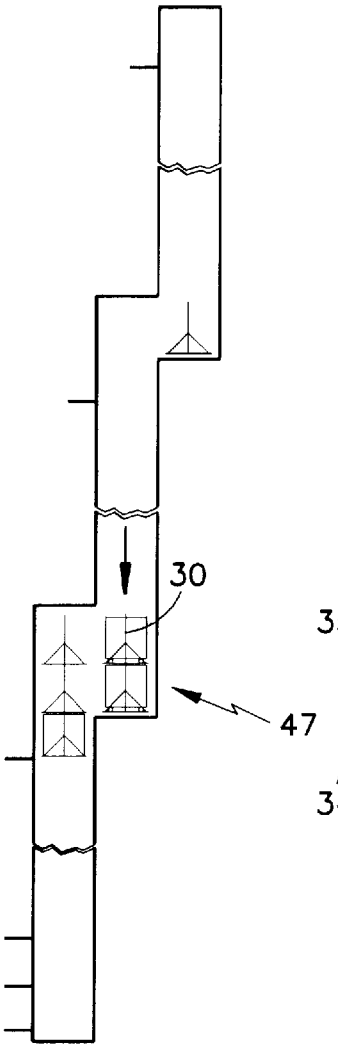
Figure 8:
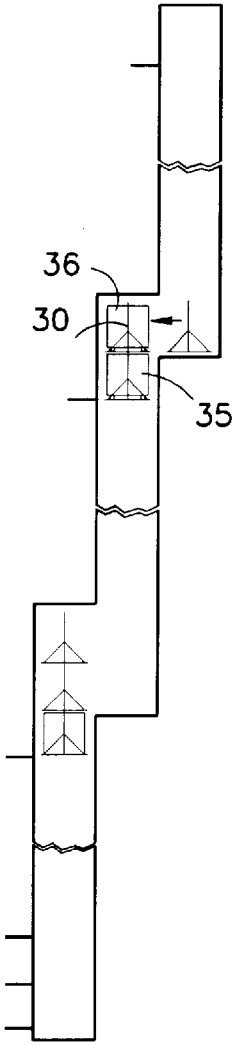

In FIG. 8, the cab 36 is transferred to the double deck car frame 30 for travel downwardly along with the cab 35 to the second upper level 47, as shown in FIG. 9. In FIG. 10, the cabs 35 and 36 are transferred to the triple deck car frame 29 for travel downwardly with the cab 34 to the ground level 42 as shown in FIG. 11, thereby completing a full, round trip run of the shuttle.

The embodiment of the invention described with respect to FIGS. 1–11 provides plural elevator cabs serving an equal number of upper levels of the building from the ground level, while only utilizing at the lowest level the core space required for a single elevator hoistway. If desired, the cab 34 could also be moveable, to serve other purposes of any sort.

Reference to FIGS. 3–9 indicate that the triple deck car frame 29 along with its cab 34 waits, for the other cabs to travel upwardly, exchange passengers, and return to the first upper level 47, an amount of time equal to the time required for the events depicted in FIGS. 3–9. Similarly, reference to FIGS. 5–7 indicate that the double deck car frame 29 waits at the second upper level 48 with its cab 35 for the length of time necessary for the cab 34 to travel to the uppermost level 49 and then return to the second upper level 48, an amount of time equal to the time required for the events depicted in FIGS. 5–7. Thus, there is some tradeoff of carrying capacity with respect to the first and second upper levels, due to the idle time of their respective car frames.

Figures 12, 13, 14, 15, 16:
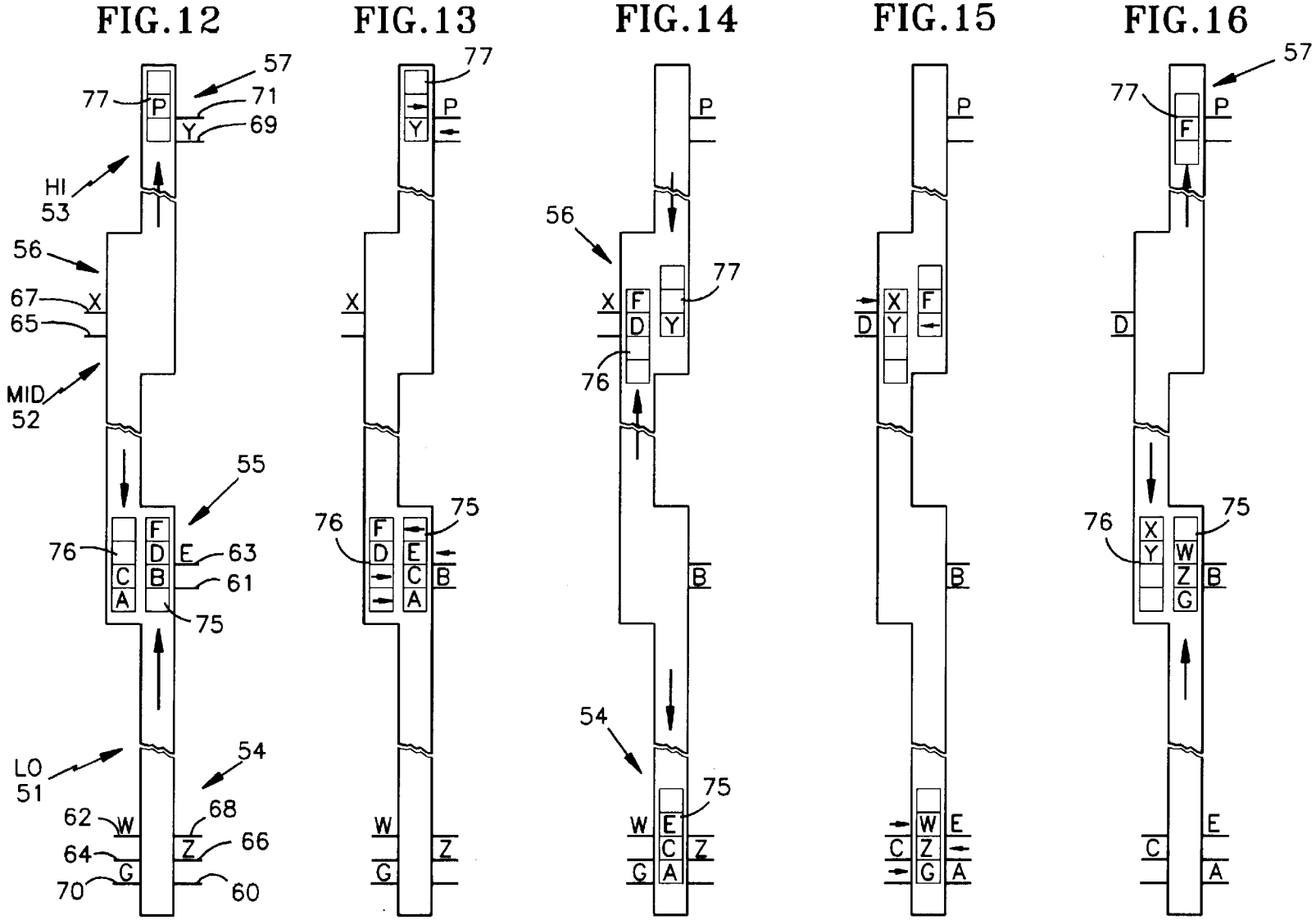
FIGS. 12–20 are simplified, stylized, schematic side elevation views of a shuttle in accordance with a second embodiment of the invention, showing the progress of elevator cabs through the building.

In FIG. 12, a plurality of overlapping, contiguous elevator hoistways include a low hoistway 51, a mid hoistway 52, and a high hoistway 53. Service is provided between a ground level 54 and first, second and third upper levels 55–57. Specifically, service is provided between a lower landing 60 at the ground level and a lower landing 61 at the first upper level; between a landing 62 at the ground level and an upper landing 63 at the first upper level; a mid landing 64 at the ground level and a lower landing 65 at the second upper level; between a mid landing 66 and an upper landing 67 at the second upper level; between an upper landing 68 at the ground level and a lower landing 69 at the third upper level; and between a landing 70 at the ground level and an upper landing 71 at the third upper level.

The low hoistway 51 and the mid hoistway 52 each have a four deck car frame 75, 76 therein, and the high hoistway 53 has a triple deck car frame 77 therein. In the three-hoistway embodiment of FIGS. 12–20, there are a total of two cabs for each level including the ground level. At any point in time, half of the cabs are in the car frames and half of the cabs are on landings. In FIGS. 12–20, the cabs are denoted simply by capital letters, which represent moveable cabs such as cabs 35 and 36 in FIGS. 1–11.

In FIG. 12, the car frames 75 and 77 have just completed an upward run, and the car frame 76 has just completed a downward run. The car frames 75 and 76 always reach the same position at the first upper level 55, but the car frames 76 and 77 land at different positions at the second and third upper levels 56, 57, as is described more fully hereinafter. In FIG. 13, transfers to the left are made in the upper two decks of the car frames 75 and 76, along with the upper landing 63 and transfers to the right are made between the lower decks of the car frames 75, 76 along with the landing 61. In FIG. 13, cabs are exchanged between the car frame 77 and the landings 69, 71 at the third upper level. In FIG. 14, the car frames 75 and 77 each complete a down run, and the car frame 76 completes an up run.

Figure 20:
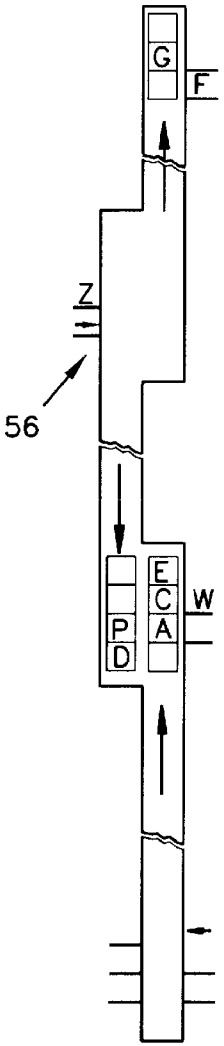
Figure 19:
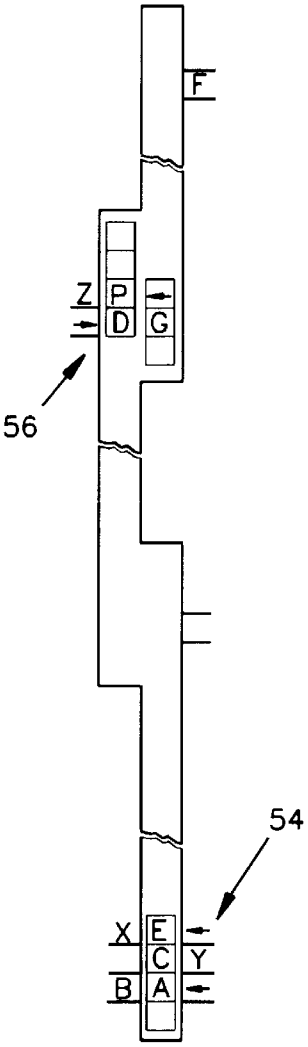
Figure 18:
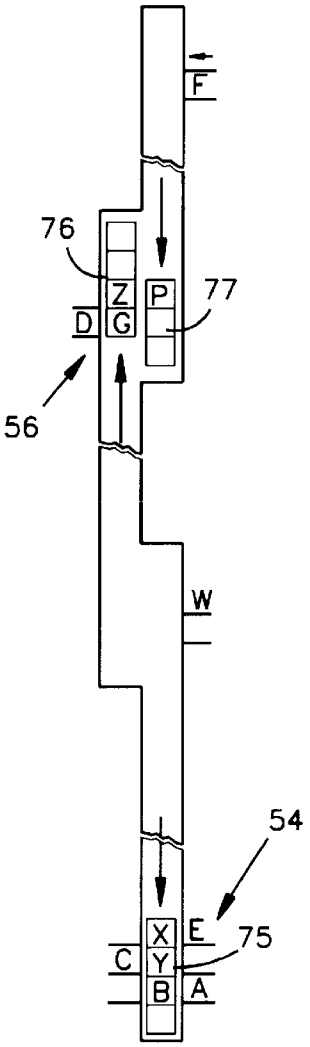
Figure 17:
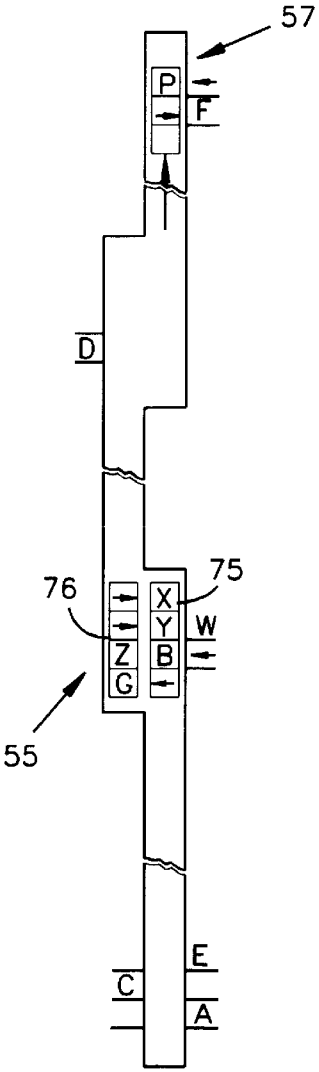

In FIG. 14, each of the car frames 75–77 has been stopped at a particular position which differs from run to run for the car frames at the ground level 54 and the second upper level 56. Specifically, the car frame 75 has been stopped in an upper position at the ground level; the car frame 76 is stopped in a lower position at the second upper level, which is two decks lower than its other position; and the car frame 77 is stopped in an upper position at the second upper level which is one deck higher than another position than it can stop in. In FIG. 15, cabs are exchanged at the second upper level and at the ground level. In FIG. 16, the car frames 75, 76 once again become aligned at the first lower level, and the car frame 77 stops at a low position at the third upper level 57. In FIG. 17, cabs are exchanged at the first upper level 55 and the third upper level 57. In FIG. 18, the car frame 75 travels to a low position at the ground level 54, the car frame 76 goes to a high position at the second upper level 56 and the car frame 77 goes to a low position at the second upper level. In FIG. 19, cabs are exchanged at the ground level 54 and at the second upper level 56. In FIG. 20, the conditions are the same as in FIG. 12 except that different specific cars are in the various positions.

The pattern between FIG. 12 and FIG. 9 takes eight cycles, and then repeats as is seen by comparison of FIGS. 12 and 20, except for the cabs being in different spots. In fact, in 24 cycles, the cabs will return to the same landings. As an example, cab A will go from landing 60 to landing 61, and then back down to landing 70; then it will go to landing 71 and return to landing 64; then it will go to landing 65 and return to landing 60. In each case, the cab travels from the ground level 54 to one of the first, second or third upper levels, and then back to the ground level 54. Therefore, the trip for each cab represents a shuttle trip to a particular one of the upper levels, with no hall stops in between.

The embodiment of FIGS. 12–20 moves three cabs up and down in the lowest hoistway, two cabs in the next higher hoistway, and one cab in the highest hoistway, as does the embodiment of FIGS. 1–11. In the embodiment of FIGS. 12–20, however, there are cabs moving in all of the hoistways substantially all of the time (except for the short intervals where cab exchange occurs). In addition, the same service is provided to all three levels since there are three cabs moving toward or away from the third highest level, two cabs moving toward or away from the second highest level, and one cab moving toward or away from the first upper level. Therefore, there will be the same number of cabs per unit of time arriving and departing on each of the upper levels, in both embodiments.

In operation, it is assumed that each moveable elevator cab will be locked down to the car frame in which it is riding by cab/car locks, which may be of the type disclosed in commonly owned, copending U.S. patent application Ser. No. 08/565,658, filed Nov. 29, 1995. It is also assumed that each elevator cab will be locked to the building before cabs are moved from the car frame. This is particularly important in the embodiment of FIGS. 1–11 where the load on the car frame will change significantly as a result of moving a cab onto or off of the car frame. Locks of this type are disclosed in commonly owned U.S. patent application Ser. No. 08/565,648 filed Nov. 29, 1995. Simultaneous transfer between car frames and landings, and synchronizing controls to perfect the same, is fully disclosed in a commonly owned copending U.S. patent application Ser. No. 08/564,534 filed on Nov. 29, 1995.

Figure 21:
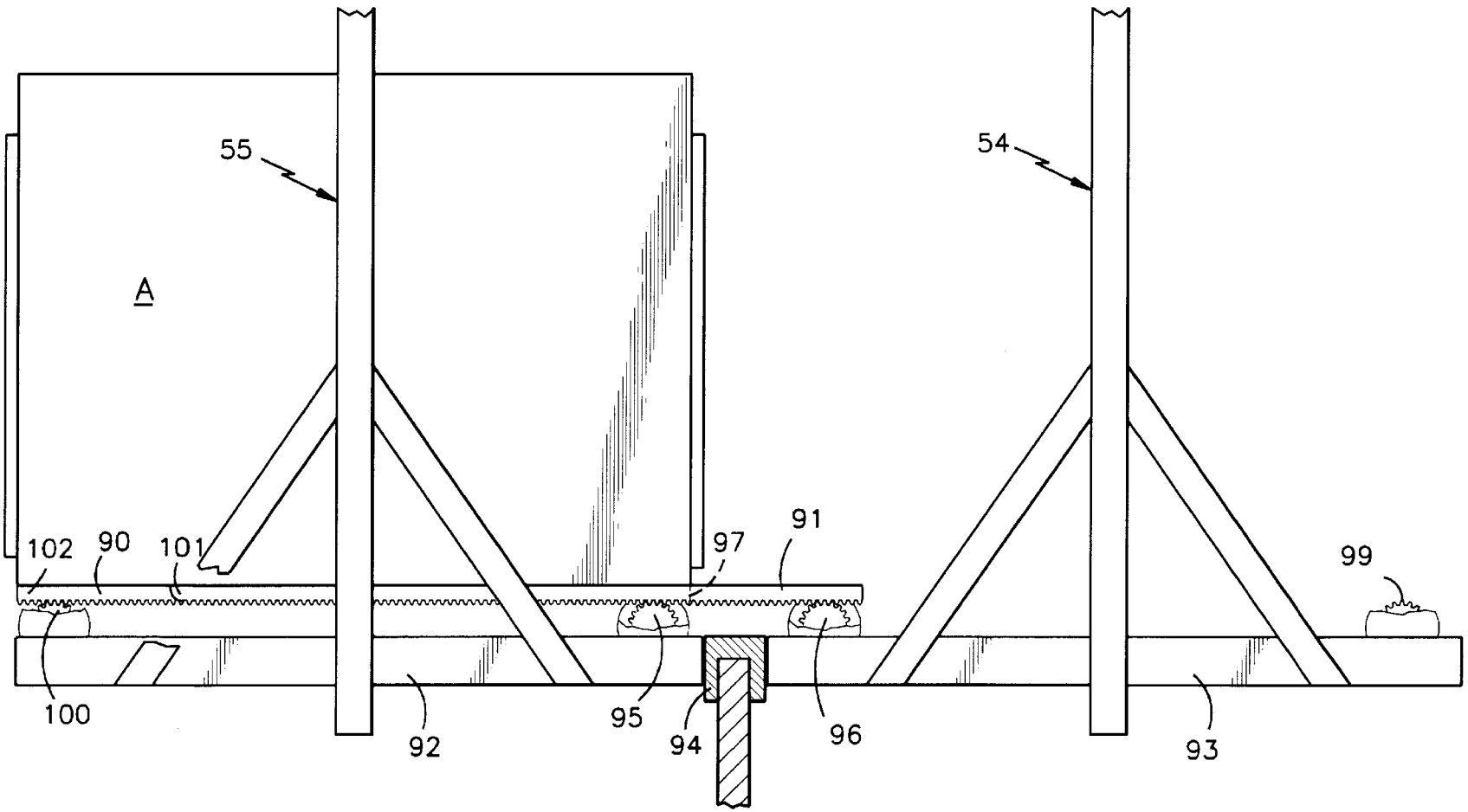
FIG. 21 is a simplified, stylized side elevation view of a horizontal motion means for use with the invention.
Figures 22, 23, 24, 25, 26, 27, 28:
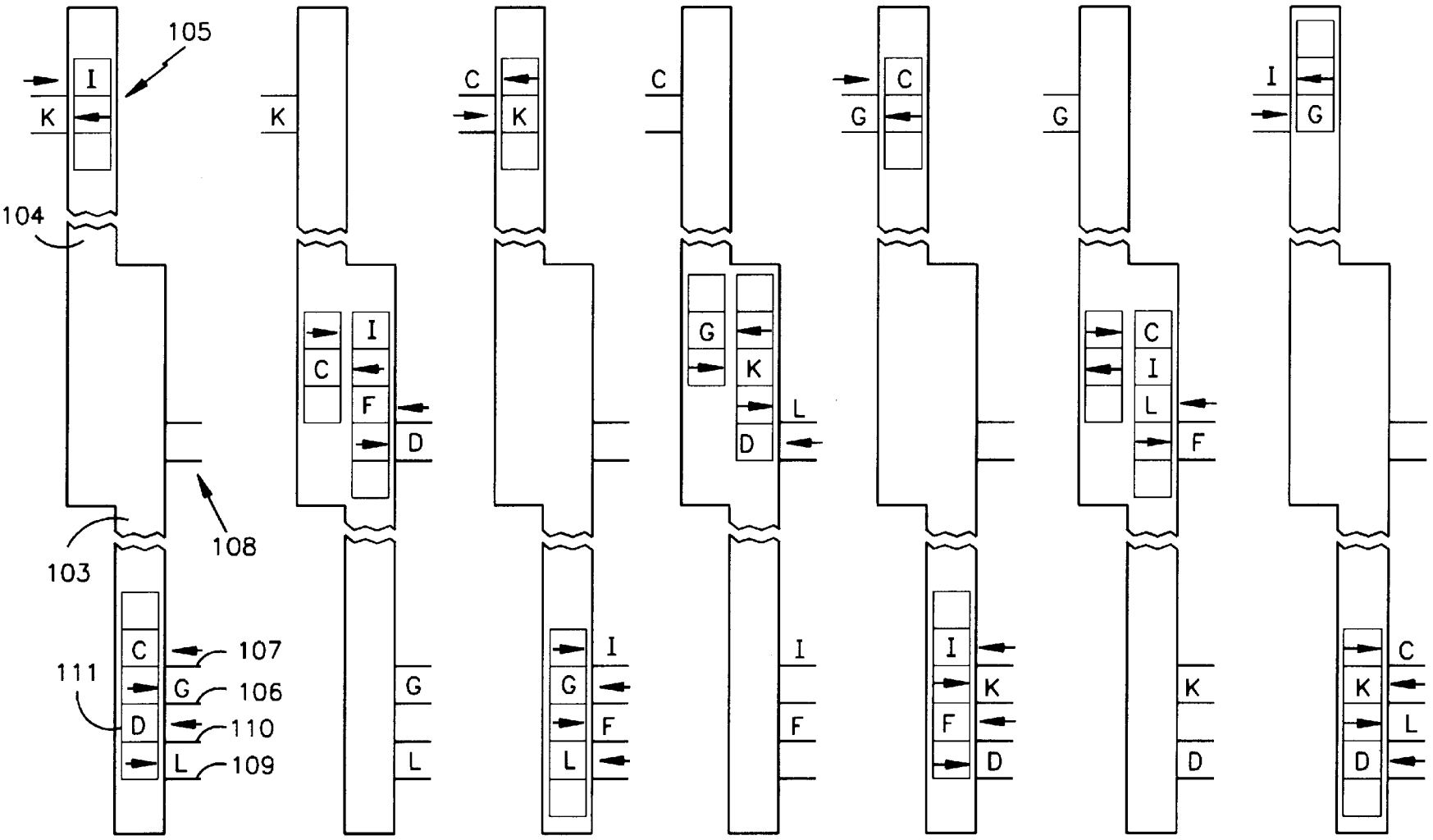
FIGS. 22–28 are simplified, stylized, side elevation views of a shuttle in accordance with a third embodiment of the invention, showing the progress of elevator cabs through the building.
Figure 33:
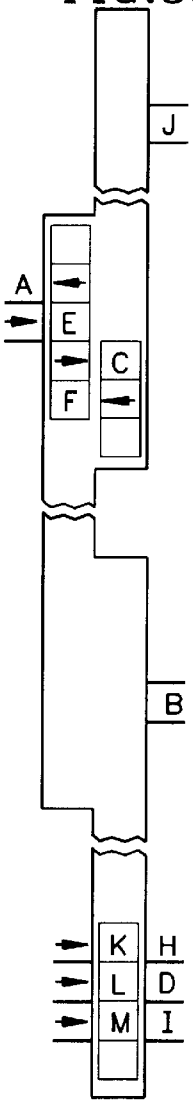
FIGS. 29–43 are simplified, stylized, schematic side elevation views of a shuttle in accordance with a fourth embodiment of the invention, showing the progress of elevator cabs through the building.
Figure 32:
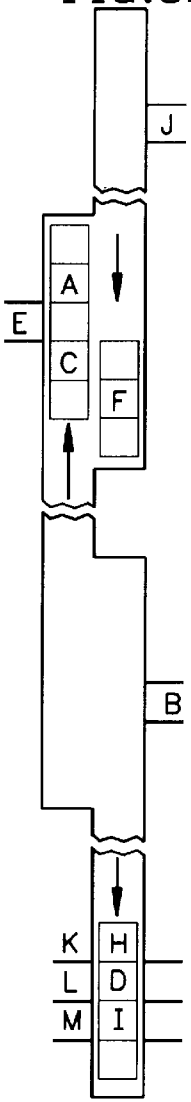
Figure 31:
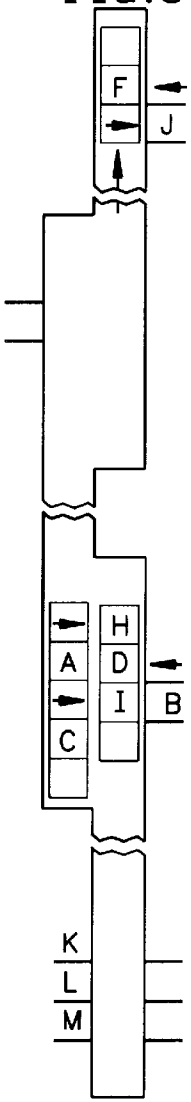
Figure 30:
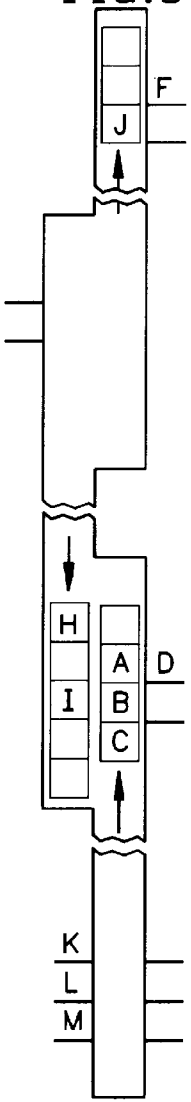
Figure 29:
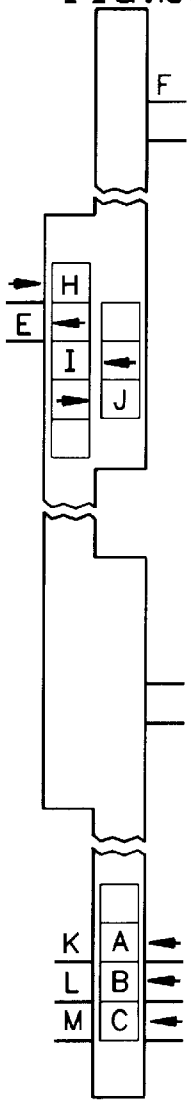
Figure 38:
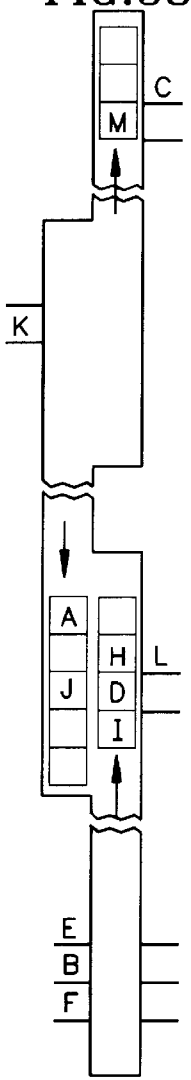
Figure 37:
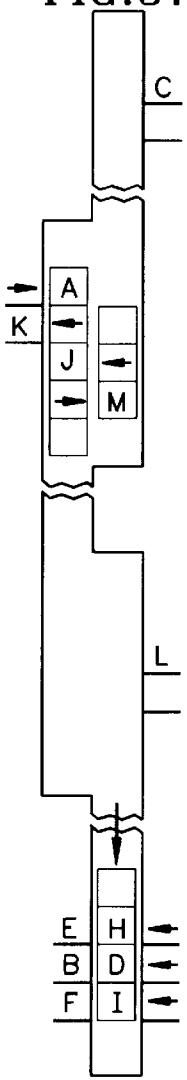
Figure 36:
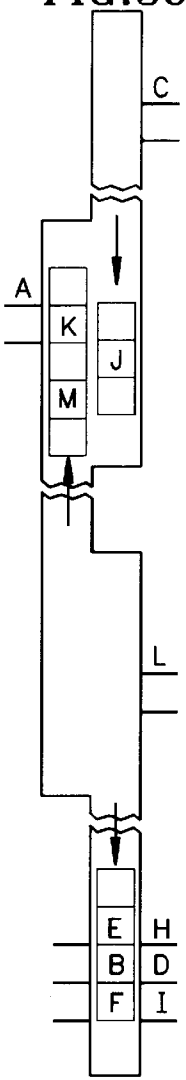
Figure 35:
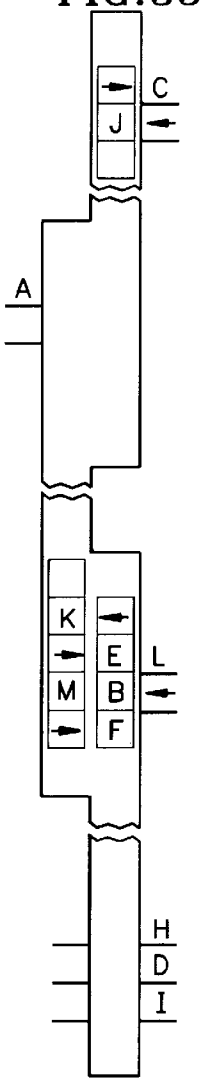
Figure 34:
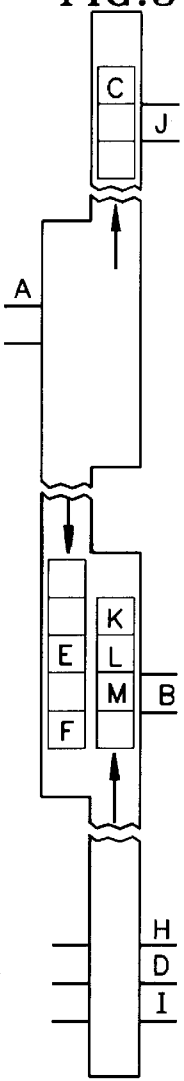
Figures 39, 40, 41, 42, 43:
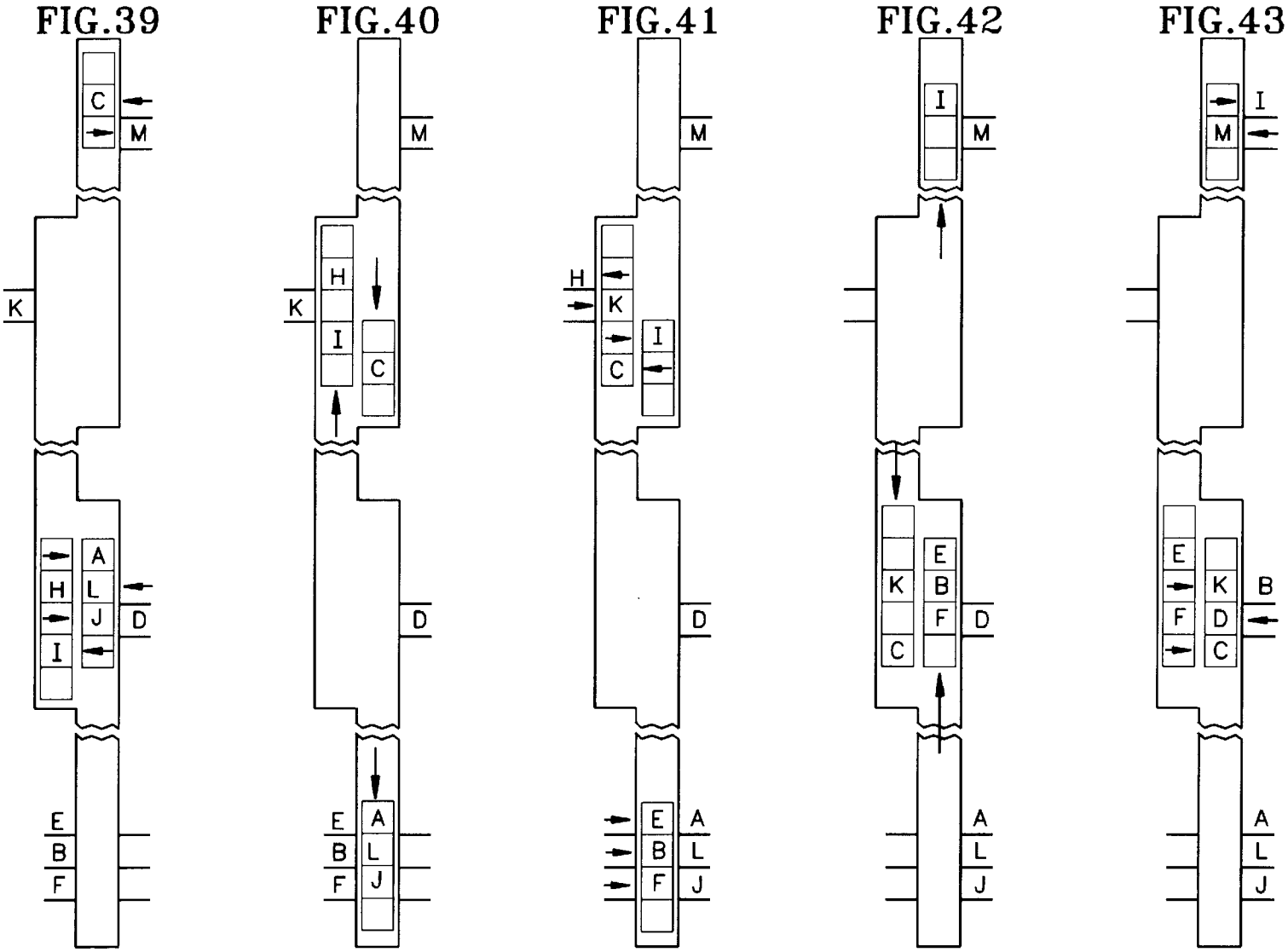

FIG. 21 illustrates horizontal motive means for moving the cabs between car frames and between landings and car frames, as it may appertain to FIG. 13. This is shown more fully in commonly owned U.S. patent application Ser. No. 08/564,704 filed Nov. 29, 1995. In FIG. 19, the bottom of the cab A has a fixed, main rack 90 extending from front to back (right to left in FIG. 21), and a sliding auxiliary rack 91 that can slide outwardly to the right, as shown, or to the left. There are a total of four motorized pinions on each lower deck platform 92, 93 (as well as on each upper deck platform, not shown in FIG. 21) of the car frames 54, 55, as well as on all landings in FIGS. 12–20, not shown. First, an auxiliary motorized pinion 95 turns clockwise to drive the sliding auxiliary rack 91 out from under the cab into the position shown, where it can engage an auxiliary motorized pinion 96 on the platform 93, which is the limit that the rack 91 can slide. Then, the auxiliary motorized pinion 96 will turn clockwise pulling the auxiliary rack 91 (which now is extended to its limit) and therefore the entire cab A to the right as seen in FIG. 21, over a sill 94, until such time as an end 97 of the main rack 90 engages a main motorized pinion (not shown) which is located just behind the auxiliary motorized pinion 96 in FIG. 21. Then, that main motorized pinion will pull the entire cab A fully onto the platform 93 by means of the main rack 90, and as it does so, a spring causes the sliding auxiliary rack 91 to retract under the cab A. An auxiliary motorized pinion 99 can assist in moving the cab A to the right onto the landing 60. Similarly, an auxiliary pinion 100, similar to pinion 96, could assist in moving a cab from the car frame 76 onto the landing 65.

To return the cab A from the platform 93 to the platform 92, the auxiliary pinion 96 will operate counterclockwise, causing the sliding auxiliary rack 91 to move outwardly to the left until its left end 101 engages the auxiliary pinion 95. Then the auxiliary pinion 95 pulls the auxiliary rack 91 and the entire cab A to the left until the left end 102 of the main rack engages a main motorized pinion (not shown) located behind the auxiliary motorized pinion 75, which then pulls the entire cab A to the left until it is fully on the frame 22.

In the embodiment of FIGS. 1–12, the high hoistway 28 may be disposed above the low hoistway 26 and the landings 39–41 and 44 might be on the other side of the hoistways from that shown. In the embodiment of FIGS. 12–20, the cabs at the ground level might have been placed in landings opposite to those shown. Similarly, the landings 69 and 71 might be on the opposite sides of the hoistway from that shown, or there may be one landing on each side of the high hoistway 53. Further, the high hoistway 53 need not necessarily be over the low hoistway 51, provided the landings 65, 67 are moved to the opposite side of the mid hoistway 52. All of this is totally irrelevant to the present invention.

In the embodiment of FIGS. 12–20 only the service to landings 65 and 67 at the second upper level is reachable from the same floor of the ground level (the second floor), at landings 64 and 66. The first upper level landings 61, 63 are reached either from the first floor landing 60 on the left of the hoistway or the third floor landing 62 on the right of the hoistway. Similarly, the landings 69, 71 at the third upper level are reached either from the landing 68 which is on the third floor to the right of the hoistway or from landing 70 which is on the first floor to the left of the hoistway. In some installations, this may not be an acceptable boarding pattern. This is caused by the fact that the upper two decks of the car frame 75 may have cabs relating to either the second upper level or the third upper level, and the low two decks of the car frame 75 may have cabs relating to either the first upper level or the second upper level. This can be overcome by use of car frames having additional decks.

In the embodiment of FIGS. 22–28, only two hoistways 103, 104 are used. In that embodiment, all service to a second upper level 105 is provided from landings 106, 107 on the right side of the hoistway at the third and fourth floors; all service to a first upper level 108 is provided by landings 109, 110 at the right side of the elevator on the first and second floors. This is accomplished by always keeping the cabs related to the second upper level 105 above the cabs related to the first upper level 108 by means of a five deck elevator car frame 111. In each case, there is an empty deck between the cab-carrying decks. Operation of the embodiment of FIGS. 22–28, being evident in the light of the description of FIGS. 12–20 hereinbefore, is not described further.

The embodiment of FIGS. 29–43 utilizes three hoistways 120–122 to serve a first upper level 123, a second upper level 124, and a third upper level 125 from a ground level 126. In this embodiment, the car frame 130 in the lowest hoistway 120 requires only a single extra deck, the car frame 131 in the highest hoistway 122 requires two extra decks, and the car frame 132 in the middle hoistway 121 requires three extra decks, in order to ensure that the cabs are always in the same vertical order in the car frame 130, which is the second upper level on top, the first upper level in the middle, and the third upper level on the bottom. Cabs related to the first upper level must be in the middle because the cabs at the first upper level are exchanged alternatively with those at the second upper level and with those at the third upper level. This arrangement results in all departures for the second upper level being from the third floor, although on both sides of the hoistway, all departures for the first upper level being on the second floor, and all departures for the third upper level being on the first floor. However, the floor utilized to service the second and third upper levels can be reversed, simply by having the elevator car frame 32 service the second upper level with the lowest three decks thereof, rather than with the highest three decks thereof, and having the car frame 131 align itself with the upper decks of the car frame 132, rather than with the lower decks thereof.

All of these arrangements are available in the form disclosed and in various other modified forms in order to take advantage of the principles of the present invention, which permit piggybacking cabs for successive levels on the same car frames, thereby minimizing the use of building core at the lowest levels of the building. If desired, the landings at the highest level in the embodiments of FIGS. 22–28 and of FIGS. 29–43 may be on a single floor, on opposite sides of a hoistway. Further, the embodiments of FIGS. 22–28 may have the landings disposed on only two floors, on opposite sides of the hoistway, but service for either of the upper levels will consistently be from the same, single floor at the lowest level. In the embodiment of FIGS. 29–43, all of the landings at the lowest level may be on the same side of the hoistway, if desired, however, that will require six floors of landings and a seven-deck car frame for the lowest hoistway.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of providing elevator service between a first level of a building and N other levels of the building vertically remote from said first level and each vertically remote from the other, comprising:

simultaneously moving N elevator cabs between said first level of said building and a second level of said building in an elevator car frame having at least N decks within a first hoistway;

at said second level, transferring exactly N−1 elevator cabs to a second car frame having at least N−1 decks in a second hoistway contiguous with and overlapping said first hoistway; and simultaneously moving said exactly N−1 elevator cabs between said second level and a third level of said building in said second hoistway.

2. A method according to claim 1 further comprising:

at said third level, transferring exactly N−2 elevator cabs from said second car frame to a third car frame having at least N−2 decks in a third hoistway overlapping and contiguous with said second hoistway; and simultaneously moving said exactly N−2 elevator cabs between said third level of said building and a fourth level of said building on said third car frame.

3. A method according to claim 2, wherein:

said step at said second level comprises transferring an elevator cab to a landing and transferring exactly N−1 elevator cabs from said second car frame to said first car frame; and said step at said third level comprises transferring an elevator cab to a landing and transferring N−2 elevator cabs from said third car frame to said second car frame.

4. A method according to claim 1 wherein:

said step at said second level comprises transferring an elevator cab to a landing and transferring exactly N−1 elevator cabs from said second car frame to said first car frame.

5. An elevator shuttle system comprising:

a number, N, of hoistways for providing elevator service between a first level of a building and N other levels of a building, vertically remote from said first level and each vertically remote from the other, each of said hoistways except the lowest comprising an upper hoistway having its lower end contiguous and overlapping with the upper end of another one of said hoistways, each of said hoistways except the highest having its upper end overlapping and contiguous with the lower end of another one of said hoistways;

a car frame for each of said hoistways, the car frame of the lowest hoistway having N decks, the car frame for each other hoistway having one less deck than the number of decks of the car frame in the hoistway below it in said shuttle system;

a plurality of elevator cabs, there being one elevator cab for each of said hoistways; the elevator cabs in each of said upper hoistways being horizontally moveable; and horizontal motive means for moving said horizontally moveable elevator cabs between a car frame in any one of said hoistways and a car frame in another one of said hoistways which overlaps and is contiguous therewith.

6. An elevator shuttle system comprising:

a number, N, of hoistways for providing elevator service between a first level of a building and N other levels of a building, vertically remote from said first level and each vertically remote from the other, each of said hoistways except the lowest having its lower end contiguous and overlapping with the upper end of another one of said hoistways, each of said hoistways except the highest having its upper end overlapping and contiguous with the lower end of another one of said hoistways;

2N landings at said first level and 2 landings at each other one of said levels;

a multideck car frame for each of said hoistways, the decks of said car frames being vertically aligned with said landings when said car frames are brought to rest at said levels;

a plurality of horizontally moveable elevator cabs, the number of said elevator cabs equaling three plus H elevator cabs for each of said hoistways, where H equals the number of hoistways below said each hoistway in said system; and horizontal motive means for exchanging said elevator cabs between the car frame of any one of said hoistways and the car frame of another one of said hoistways which overlaps and is contiguous therewith at a given level, said cabs exchanged at each given level including one downwardly traveling cab and one upwardly traveling cab for each of said levels above said given level, for exchanging N upwardly traveling cabs with N downwardly traveling cabs between the landings at said first level and the car frame of said lowest hoistway, and for exchanging one upwardly traveling cab with one downwardly traveling cab between the landings at said other levels and the corresponding car frame.

* * * * *